US008746211B2

(12) United States Patent
Aso et al.

(10) Patent No.: US 8,746,211 B2
(45) Date of Patent: Jun. 10, 2014

(54) CONTROL APPARATUS AND CONTROL METHOD FOR INTERNAL COMBUSTION ENGINE

(75) Inventors: Koji Aso, Susono (JP); Hiroshi Tanaka, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 339 days.

(21) Appl. No.: 13/031,408

(22) Filed: Feb. 21, 2011

(65) Prior Publication Data

US 2011/0203552 A1 Aug. 25, 2011

(30) Foreign Application Priority Data

Feb. 19, 2010 (JP) ..... 2010-034670

(51) Int. Cl.
*F02D 41/06* (2006.01)

(52) U.S. Cl.
USPC ..... 123/443; 123/179.16; 123/481; 123/491; 701/104

(58) Field of Classification Search
USPC ..... 123/179.1, 179.7, 179.8, 179.16, 406.3, 123/406.31, 406.32, 443; 701/113
See application file for complete search history.

(56) References Cited

U.S. PATENT DOCUMENTS 5,690,073 A * 11/1997 Fuwa ..... 123/443
5,809,973 A * 9/1998 Iida et al. ..... 123/491
5,836,288 A * 11/1998 Nakagawa ..... 123/491
6,112,723 A * 9/2000 Itoyama et al. ..... 123/491
6,125,812 A * 10/2000 Garabedian ..... 123/198 F
6,382,188 B2 * 5/2002 Hasegawa et al. ..... 123/491
6,874,463 B1 * 4/2005 Bolander et al. ..... 123/198 F
6,931,839 B2 * 8/2005 Foster ..... 60/284
7,987,043 B2 * 7/2011 Tashima et al. ..... 701/113
2002/0038541 A1 * 4/2002 Sumilla et al. ..... 60/274
2003/0037771 A1 * 2/2003 Yuya et al. ..... 123/491
2003/0217739 A1 11/2003 Saeki et al.
2005/0193988 A1 * 9/2005 Bidner et al. ..... 123/481
2008/0060609 A1 * 3/2008 Surnilla et al. ..... 123/299
2009/0076706 A1 * 3/2009 Nakamura et al. ..... 701/103
2009/0088948 A1 * 4/2009 Nakagawa et al. ..... 701/103
2010/0036587 A1 * 2/2010 Kato et al. ..... 701/103
2010/0063710 A1 * 3/2010 Asai et al. ..... 701/103
2011/0088661 A1 * 4/2011 Sczomak et al. ..... 123/481

FOREIGN PATENT DOCUMENTS

JP 03-253745 A 11/1991
JP 08338282 A 12/1996
JP 2003343367 A 12/2003
JP 2005351120 A 12/2005

(Continued)

*Primary Examiner* — Stephen K Cronin
*Assistant Examiner* — John Zaleskas
(74) *Attorney, Agent, or Firm* — Gifford, Krass, Sprinkle, Anderson & Citkowski, P.C.

(57) ABSTRACT

A control apparatus for an internal combustion engine starts the internal combustion engine by initiating combustion in cylinders belonging to a first cylinder group, from among a plurality of cylinders that make up the internal combustion engine. The control apparatus monitors a change in an amount of negative pressure generated in an intake pipe when the internal combustion engine is started, and obtains information related to an alcohol concentration of fuel used in the internal combustion engine. The control apparatus also calculates a fuel injection quantity necessary to initiate combustion in cylinders belonging to a second cylinder group, based on the amount of negative pressure generated in the intake pipe and the alcohol concentration of the fuel, and initiates combustion in each cylinder belonging to the second cylinder group when the necessary fuel injection quantity enters a range of quantities that are able to be injected by corresponding injectors.

7 Claims, 4 Drawing Sheets

(56) References Cited

FOREIGN PATENT DOCUMENTS

| | | | |
|---|---|---|---|
| JP | 2009002199 | A | 1/2009 |
| JP | 2009-047004 | A | 3/2009 |
| JP | 2009144613 | A | 7/2009 |

* cited by examiner

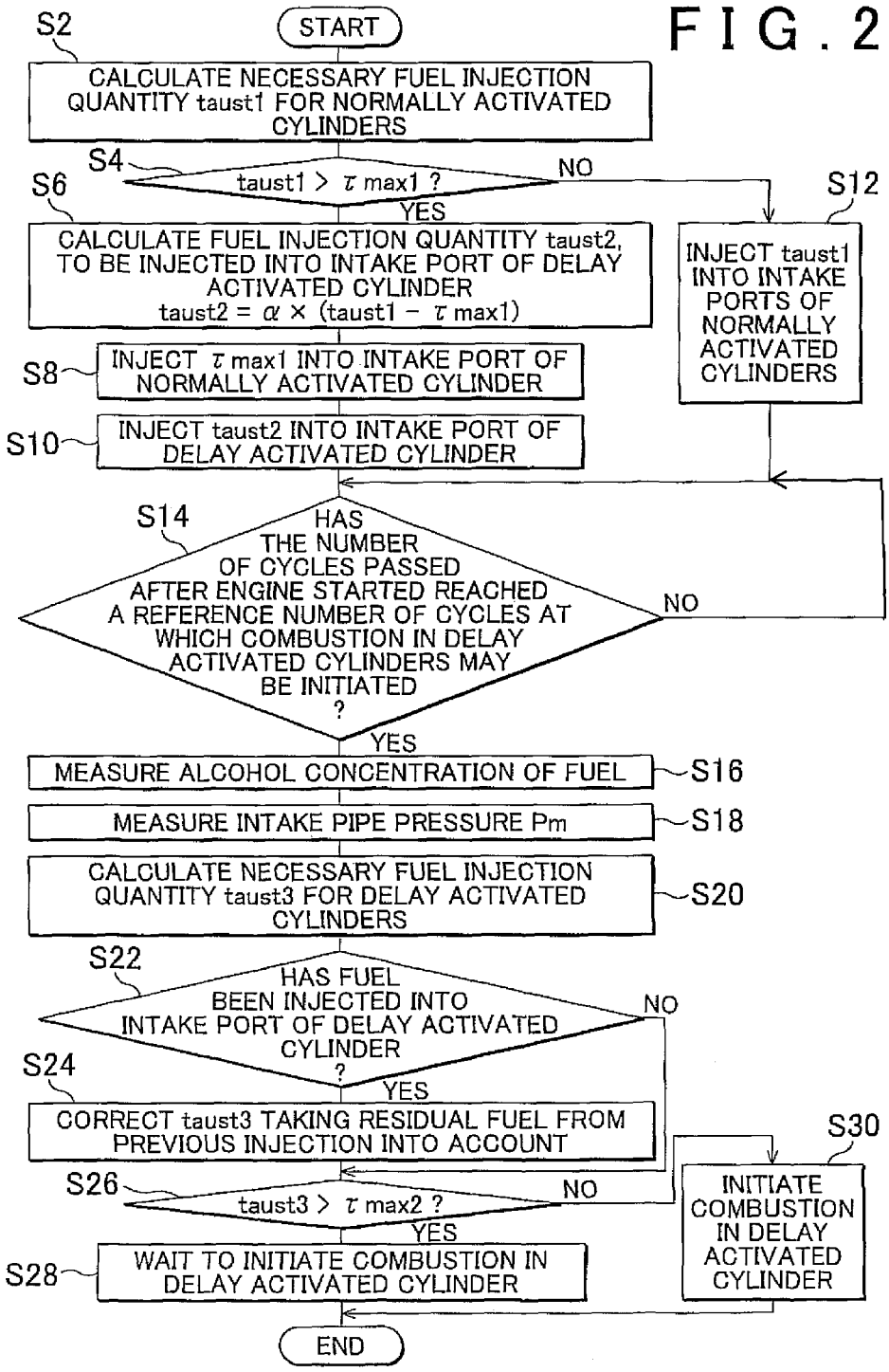
FIG. 2
START
S2
CALCULATE NECESSARY FUEL INJECTION QUANTITY taust1 FOR NORMALLY ACTIVATED CYLINDERS
S4
taust1 > τ max1 ?
NO
YES
S6
CALCULATE FUEL INJECTION QUANTITY taust2, TO BE INJECTED INTO INTAKE PORT OF DELAY ACTIVATED CYLINDER
taust2 = α × (taust1 − τ max1)
S12
INJECT taust1 INTO INTAKE PORTS OF NORMALLY ACTIVATED CYLINDERS
S8
INJECT τ max1 INTO INTAKE PORT OF NORMALLY ACTIVATED CYLINDER
S10
INJECT taust2 INTO INTAKE PORT OF DELAY ACTIVATED CYLINDER
S14
HAS THE NUMBER OF CYCLES PASSED AFTER ENGINE STARTED REACHED A REFERENCE NUMBER OF CYCLES AT WHICH COMBUSTION IN DELAY ACTIVATED CYLINDERS MAY BE INITIATED ?
NO
YES
MEASURE ALCOHOL CONCENTRATION OF FUEL
S16
MEASURE INTAKE PIPE PRESSURE Pm
S18
CALCULATE NECESSARY FUEL INJECTION QUANTITY taust3 FOR DELAY ACTIVATED CYLINDERS
S20
S22
HAS FUEL BEEN INJECTED INTO INTAKE PORT OF DELAY ACTIVATED CYLINDER ?
NO
YES
S24
CORRECT taust3 TAKING RESIDUAL FUEL FROM PREVIOUS INJECTION INTO ACCOUNT
S30
INITIATE COMBUSTION IN DELAY ACTIVATED CYLINDER
S26
taust3 > τ max2 ?
NO
YES
S28
WAIT TO INITIATE COMBUSTION IN DELAY ACTIVATED CYLINDER
END

#1
#3
#5
#7
IN-stop
×
×
○
×
×

CONTROL APPARATUS AND CONTROL METHOD FOR INTERNAL COMBUSTION ENGINE

CROSS-REFERENCE TO RELATED APPLICATION

This application claims priority to Japanese Patent Application No. 2010-034670 filed on Feb. 19, 2010, which is incorporated herein by reference in its entirety including the specification, drawings and abstract.

BACKGROUND OF THE INVENTION

1. Field of the Invention

The invention relates to a control apparatus and a control method for an internal combustion engine. More particularly, the invention relates to a control apparatus and a control method for a multiple cylinder internal combustion engine that injects fuel containing alcohol into an intake port of each cylinder from an injector provided for each cylinder.

2. Description of the Related Art

Although some fuel that is injected from a fuel injection valve into an intake port in an internal combustion engine vaporizes immediately, the rest of the fuel temporarily adheres to the wall surface of the intake port. The fuel that has adhered to the intake port vaporizes from negative pressure inside the intake pipe or the heat from the wall surface of the intake port and, together with vaporized portion of the fuel that has been newly injected from the fuel injection valve, forms an air-fuel mixture. During steady operation, the amount of fuel that is injected from the fuel injection valve and adheres to the intake port is balanced with the amount of fuel adhered to the intake port that vaporizes. Therefore, the air-fuel ratio of the air-fuel mixture that forms inside the cylinder can be made to match a stoichiometric air-fuel ratio by injecting an amount of fuel that corresponds to the stoichiometric air-fuel ratio from the fuel injection valve.

Incidentally, when starting the internal combustion engine, especially during a cold start, the temperature inside the intake pipe and the temperature of the wall surface of the intake port is low, and there is no negative pressure inside the intake pipe. Moreover, not much fuel is adhered to the intake port prior to startup. As a result, a large portion of the fuel that is injected from the fuel injection valve at startup adheres to the intake port. Accordingly, in order to form an air-fuel mixture of an ignitable concentration, a larger amount of fuel must be supplied at least in the initial cycle at startup than that is supplied during steady operation after the engine has warmed up. Also, the fuel is supplied by cylinder, so with a multiple cylinder internal combustion engine that has many cylinders, a large amount of fuel is supplied sequentially to each cylinder. However, when a large amount of fuel is supplied, a corresponding large amount of unburned hydrocarbons (HC) is discharged from the cylinders to the exhaust pipe. Although a catalyst for purifying the exhaust gas is provided in the exhaust pipe, it takes a certain amount of time for the catalyst to activate (or more specifically, for the purifying ability of the catalyst to activate) at startup when the temperature of the catalyst is low. Therefore, it is desirable to suppress the discharge of unburned HC from the cylinders as much as possible at least until the catalyst is activated. Reducing unburned HC produced at startup is a major concern in vehicles that use an internal combustion engine as a source of power.

To date, various technologies have been proposed to address this concern. One such technology is described in Japanese Patent Application Publication No. 8-338282 (JP-A-8-338282) and relates to fuel supply during startup of a multiple cylinder internal combustion engine. As described in JP-A-8-338282, it is not always necessary to supply a large amount of fuel sequentially to each cylinder in order to start a multiple cylinder internal combustion engine. That is, an internal combustion engine can be started even when the supply of fuel to some of the cylinders is stopped. Starting an internal combustion engine while the supply of fuel to some of the cylinders is stopped enables the amount of unburned HC discharged at startup to be significantly reduced. The technology in JP-A-8-338282 is an invention that is based on such knowledge, and determines those cylinders to which fuel should be supplied and those cylinders to which the supply of fuel should be stopped, based on the results of a cylinder determination at startup, and then controls the fuel supply to each of the cylinders according to that determination.

In this example embodiment, an alcohol blended fuel in which alcohol such as ethanol is blended with gasoline may be used as the fuel. However, the properties of alcohol are different from the properties of gasoline. The most remarkable difference between the properties of alcohol and gasoline is the distillation characteristic. Fuel that contains alcohol is less evaporative at low temperatures than gasoline is. This is because the alcohol has fewer low-boiling components than gasoline does. Low volatility of alcohol is particularly problematic when starting an internal combustion engine. During startup of an internal combustion engine, the amount of fuel that is injected must be increased in consideration of the fact that some of the fuel will adhere to the intake port. When fuel containing alcohol which is not very volatile is used, the amount of this increase needs to be larger than it is when gasoline is used. However, there is a limit to the injection performance of the injector that injects the fuel, so depending on the alcohol concentration of the fuel that is used, the necessary amount of fuel may not be able to be injected. In such a case, the air-fuel ratio of the air-fuel mixture that flows into the cylinder from the intake port becomes lean, which depending on the degree of leanness, may result in a misfire.

According to the technology described above, the amount of unburned HC discharged at startup of an internal combustion engine is able to be reduced. However, if a misfire does occur, the technology described above is unable to prevent a large quantity of unburned HC that results from the misfire from being discharged. Therefore, when the technology described above is applied to an internal combustion engine in which it is assumed that fuel containing alcohol will be used, a sufficient effect may not always be able to be obtained when the goal is to suppress the discharge of unburned HC at startup.

SUMMARY OF THE INVENTION

The control apparatus and the control method for an internal combustion engine of this invention suppresses the discharge of unburned HC by starting the internal combustion engine by initiating combustion in only some of a plurality of cylinders, and then initiating combustion in the remaining cylinders after the internal combustion engine has started, even if fuel containing alcohol is used.

A first aspect of the invention relates to a control apparatus for an internal combustion engine that injects fuel that includes alcohol into an intake port of each cylinder from an injector provided for each cylinder. This control apparatus includes an engine starting portion, an intake pipe pressure monitoring portion, an alcohol concentration information obtaining portion, a necessary fuel injection quantity calculating portion, and a second cylinder group combustion initiating portion. The engine starting portion starts the internal combustion engine by initiating combustion in cylinders belonging to a first cylinder group. The intake pipe pressure monitoring portion monitors a change in an amount of negative pressure generated in an intake pipe with the starting of the internal combustion engine. The alcohol concentration information obtaining portion obtains information related to an alcohol concentration of the fuel being used in the internal combustion engine. The necessary fuel injection quantity calculating portion calculates a fuel injection quantity necessary to initiate combustion in cylinders belonging to a second cylinder group that are different from the cylinders that make up the first cylinder group, based on the amount of negative pressure generated in the intake pipe and the alcohol concentration of the fuel. The second cylinder group combustion initiating portion initiates combustion in each of the cylinders belonging to the second cylinder group after the fuel injection quantity necessary to initiate combustion enters a range of quantities that are able to be injected by the corresponding injectors.

Negative pressure is generated in the intake pipe with the startup of the internal combustion engine. As the negative pressure in the intake pipe increases, more and more of the fuel adhered to the intake port vaporizes, so the fuel injection quantity necessary to obtain a desired cylinder inflow fuel amount decreases (i.e., less fuel needs to be injected to obtain a desired cylinder inflow fuel amount). On the other hand, as the alcohol concentration of the fuel increases, less and less of the fuel adhered to the intake port vaporizes, so a larger fuel injection quantity is necessary to obtain the desired cylinder inflow fuel amount (i.e., more fuel needs to be injected to obtain a desired cylinder inflow fuel amount). The amount of negative pressure generated in the intake pipe and the alcohol concentration of the fuel are important information related to the necessary fuel injection quantity.

In this first aspect, the necessary fuel injection quantity is accurately calculated based on the information described above after the internal combustion engine has started by initiating combustion in cylinders belonging to the first cylinder group. Then the necessary fuel injection quantity is decreased according to an increase in the negative pressure generated in the intake pipe, and combustion is initiated in each cylinder belonging to the second cylinder group when the necessary fuel injection quantity is able to be injected by the injector. Accordingly, the desired amount of fuel can be accurately supplied into the cylinder regardless of the alcohol concentration of the fuel, so the generation of unburned HC due to a lean misfire can be suppressed. Also, the generation of unburned HC due to the air-fuel ratio being overly rich can be suppressed by injecting an appropriate amount of fuel. That is, according to the first aspect described above, it is possible to obtain a sufficient unburned HC discharge suppression effect that is obtained by starting the internal combustion engine by initiating combustion in only some of the plurality of cylinders, and then initiating combustion in the remaining cylinders after the engine has started, even when fuel containing alcohol is used.

In the first aspect described above, the engine starting portion may close an intake valve or an exhaust valve of each of the cylinders belonging to the second cylinder group until combustion is initiated in each of the cylinders belonging to the second cylinder group. Also, if the fuel injection quantity necessary to initiate combustion in one or more of the cylinders belonging to the first cylinder group exceeds the range of quantities that are able to be injected by the corresponding one or more injectors, the engine starting portion may inject fuel of a quantity corresponding to the excess from one or more of the injectors belonging to the second cylinder group.

According to this structure, even if the amount of fuel supplied directly to one or more of the cylinders belonging to the first cylinder group is insufficient due to an injection performance limitation of the corresponding one or more injectors, the fuel of an amount corresponding to the deficiency can be supplied indirectly from the intake port of one or more of the cylinders belonging to the second cylinder group via the intake pipe. Therefore, it is possible to inhibit a lean misfire from occurring in one or more of the cylinders belonging to the first cylinder group due to a fuel deficiency when starting the internal combustion engine.

In the structure described above, the cylinders belonging to the second cylinder group may be adjacent to the cylinders belonging to the first cylinder group, and the number of cylinders belonging to the second cylinder group that are adjacent to each cylinder belonging to the first cylinder group may be the same for all of the cylinders belonging to the first cylinder group.

According to this structure, the amount of fuel that crosses over from one or more of the cylinders belonging to the second cylinder group via the intake pipe is inhibited from becoming uneven among the cylinders belonging to the first cylinder group.

The control apparatus having the structure described above may also include a residual fuel amount calculating portion that calculates an amount of residual fuel in the intake port of each of the cylinders belonging to the second cylinder group, based on the quantity of fuel injected into the intake port of each of the cylinders belonging to the second cylinder group before combustion is initiated in each of the cylinders belonging to the second cylinder group; and a necessary fuel injection quantity correcting portion that corrects the fuel injection quantity necessary to initiate combustion in each of the cylinders belonging to the second cylinder group according to the amount of residual fuel in the intake port.

According to this structure, the necessary fuel injection quantity is corrected taking into account the residual fuel amount in the intake port, so a more appropriate amount of fuel is able to be injected in order to initiate combustion in each of the cylinders belonging to the second cylinder group.

A second aspect of the invention relates to a control method for an internal combustion engine that injects fuel that includes alcohol into an intake port of each cylinder from an injector provided for each cylinder. This control method includes starting the internal combustion engine by initiating combustion in cylinders belonging to a first cylinder group; monitoring a change in an amount of negative pressure generated in an intake pipe with the starting of the internal combustion engine; obtaining information related to an alcohol concentration of the fuel being used in the internal combustion engine; calculating a fuel injection quantity necessary to initiate combustion in cylinders belonging to a second cylinder group that are different from the cylinders that make up the first cylinder group, based on the amount of negative pressure generated in the intake pipe and the alcohol concentration of the fuel; and initiating combustion in each of the cylinders belonging to the second cylinder group after the fuel injection quantity necessary to initiate combustion enters a range of quantities that are able to be injected by the corresponding injectors.

BRIEF DESCRIPTION OF DRAWINGS

The features, advantages, and technical and industrial significance of this invention will be described in the following detailed description of example embodiments of the invention with reference to the accompanying drawings, in which like numerals denote like elements, and wherein:

FIG. 2 is a flowchart illustrating a delayed activation control routine according to this example embodiment of the invention;

DETAILED DESCRIPTION OF EMBODIMENTS

An example embodiment of the invention will now be described with reference to FIGS. 1 to 4.

Figure 1:
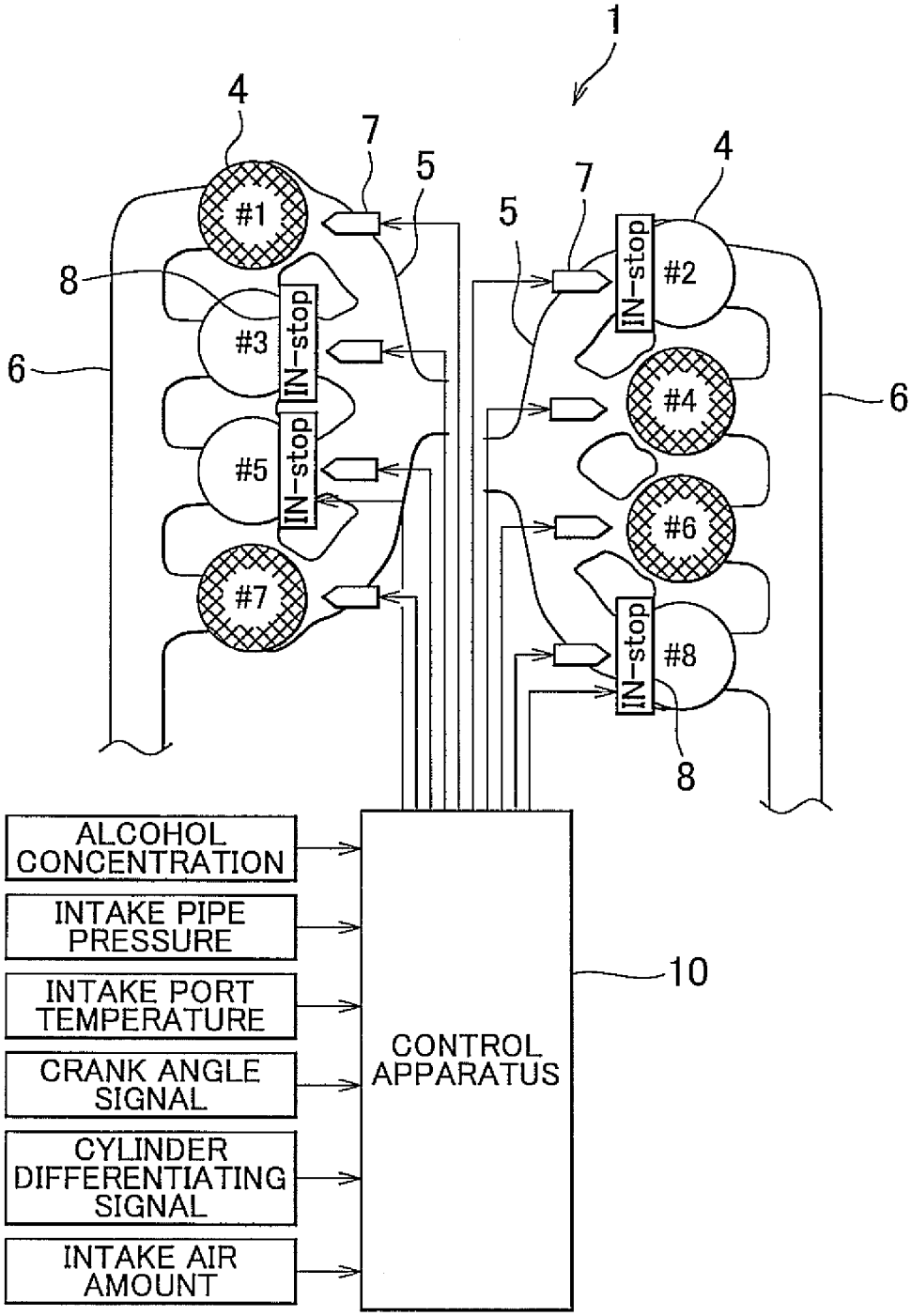
FIG. 1 is a diagram of the structure of a multiple cylinder internal combustion engine, and indicates the arrangement of normally activated cylinders and delay activated cylinders according to an example embodiment of the invention.

FIG. 1 is a view of the structure of a multiple cylinder internal combustion engine (hereinafter, simply referred to as "engine") to which the control apparatus of this example embodiment may be applied. The engine 1 shown in FIG. 1 is a V-8 four-stroke reciprocating engine that has four cylinders 4 in a left bank and four cylinders 4 in a right bank. The reference numbers #1 to #8 in FIG. 1 indicate the specific cylinder number given to each cylinder 4 (hereinafter, the Nth cylinder will be indicated as "the #N cylinder" using this cylinder number).

The #1, #3, #5, and #7 cylinders are provided in the left bank of the engine 1, and the #2, #4, #6, and #8 cylinders are provided in the right bank of the engine 1. An intake manifold 5 that supplies air to the cylinders and an exhaust manifold 6 through which exhaust gas is discharged from the cylinders are provided independently for each bank.

The engine 1 is a port injection engine that injects fuel into an intake port of each cylinder. An injector 7 is provided in an intake pipe of each of the eight cylinders 4. The fuel that is injected from the injectors 7 is supplied to the injectors 7 from a fuel tank, not shown. In this example embodiment, gasoline or alcohol or a mixed fuel of gasoline and alcohol is able to be used as the fuel of the engine 1.

The engine 1 includes intake valve stopping mechanisms 8 that stop an intake valve in a closed position. The cylinders that are provided with these intake valve stopping mechanisms 8 are the two center cylinders of the left bank, i.e., the #3 and #5 cylinders, and the cylinders on both ends of the right bank, i.e., the #2 and #8 cylinders. However, the intake valve stopping mechanisms 8 may also be provided for all of the cylinders, i.e., the #1 to #8 cylinders. The structure of these intake valve stopping mechanisms 8 is not limited.

The control apparatus in this example embodiment is realized as part of the function of an electronic control unit (ECU) 10 that controls the engine 1. The ECU 10 that serves as the control apparatus receives a variety of information and signals related to the operating state and operating conditions of the engine 1 from a variety of sensors provided both inside and outside of the engine 1. The ECU 10 operates actuators of the engine 1 based on the information and signals, and controls the operation of the engine 1 by such operation. The information or signals received by the ECU 10 includes, for example, the alcohol concentration of the fuel, the intake pipe pressure, the temperature of the intake port, a crank angle signal, a cylinder differentiating signal, and the intake air amount. The actuators that are operated by the ECU 10 include, for example, an ignition device and a throttle and the like, not shown, in addition to the injectors 7 and the intake valve stopping mechanisms 8 described above.

The ECU 10 that serves as the control apparatus executes startup control of the engine 1. In this startup control, the ECU 10 starts the engine 1 by initially initiating combustion in only some of the cylinders instead of in all of the cylinders. Then after the engine 1 has started, the ECU 10 initiates combustion in the remaining cylinders when a predetermined condition is satisfied. Hereinafter throughout this specification, startup control that starts the engine 1 by initiating combustion in only some of the cylinders will be referred to as delayed activation control of the engine 1. Also, throughout this specification, a cylinder in which combustion is initiated from the first cycle at startup will be referred to as a normally activated cylinder, and a cylinder in which combustion is initiated from the second cycle after combustion has already been initiated in the normally activated cylinders will be referred to as a delay activated cylinder.

The arrangement of the normally activated cylinders and delay activated cylinders according to this example embodiment is shown in FIG. 1. The cylinders indicated by crosshatching in FIG. 1 are normally activated cylinders, and the cylinders not indicated by crosshatching are delay activated cylinders. In FIG. 1, the #1, #4, #6, and #7 cylinders are set as the normally activated cylinders, and the #2, #3, #5, and #8 cylinders are set as the delay activated cylinders. There is a certain rule regarding the arrangement of the normally activated cylinders and the delay activated cylinders shown in FIG. 1. This rule is that a delay activated cylinder must be adjacent to a normally activated cylinder, and the number of adjacent delay activated cylinders must be the same for each of the normally activated cylinders. The intake valve stopping mechanisms 8 are provided in the #2, #3, #5, and #8 cylinders, as described above. The intake valve stopping mechanism 8 of each delay activated cylinder is operated by the ECU 10 such that the intake valve is kept closed until combustion is initiated in the corresponding delay activated cylinder. The ECU 10 manages the #1, #4, #6, and #7 cylinders that are set as normally activated cylinders as one cylinder group (i.e., a first cylinder group), and manages the #2, #3, #5, and #8 cylinders set as delay activated cylinders as another cylinder group (i.e., a second cylinder group).

Hereinafter, a delayed activation control routine executed by the ECU 10 will be described with reference to the flowchart shown in FIG. 2.

The ECU 10 starts delayed activation control when a start switch of the engine 1 (such as the ignition switch) is turned on. In the first step, step S2, the ECU 10 calculates a fuel injection quantity taust1 necessary to properly initiate combustion in each of the normally activated cylinders. This necessary fuel injection quantity taust1 may be calculated using an amount of fuel required in each of the cylinders that is determined from the amount of air in the cylinders and a target air-fuel ratio, a percentage of fuel that adheres to the intake port, from the fuel injected from the injector 7 (i.e., an adhering percentage), and the percentage of fuel that remains as it is without vaporizing, from the fuel adhered to the intake port (i.e., the residual percentage). The adhering percentage and the residual percentage of the fuel are determined by the intake port temperature and the alcohol concentration of the fuel. If the intake port temperature is low, the adhering percentage and the residual percentage will increase. If the alcohol concentration is high, the adhering percentage and the residual percentage will also be high. A map that correlates the adhering percentage and the residual percentage to the intake port temperature and the alcohol concentration is stored in the ECU 10. An adhering percentage and a residual percentage corresponding to the intake port temperature and the alcohol concentration at startup are specified using this map, and the necessary fuel injection quantity taust1 is calculated using the specified adhering percentage and the specified residual percentage.

In the next step, step S4, the ECU 10 determines whether the necessary fuel injection quantity taust1 is greater than a maximum fuel injection quantity τmax1 that is determined by the injection performance of the injector 7. The fuel injection quantity from the injector 7 is determined by the injection time and the fuel pressure. The fuel pressure is regulated to be constant, so the ECU 10 controls the fuel injection quantity according to the injection time of the injector 7, i.e., the time from the start of an injection until the end of the injection. Incidentally, at startup of the engine 1, there is sufficient time for the fuel inside the intake port to vaporize, so an intake-asynchronous injection in which fuel is injected while the intake valve is closed is performed. Therefore, the period during which fuel can be injected is limited to the period during which the intake valve is closed. The maximum fuel injection quantity τmax1 is a fuel injection quantity that is calculated from the maximum injection time able to be ensured while the intake valve is closed.

If the necessary fuel injection quantity taust1 is equal to or less than the maximum fuel injection quantity τmax1, then all of the necessary fuel injection quantity taust1 can be supplied to the normally activated cylinders. In this case, the ECU 10 executes step S12. In step S12, fuel is injected from the injectors 7 into each of the normally activated cylinders for the injection time corresponding to the necessary fuel injection quantity taust1.

If, on the other hand, the necessary fuel injection quantity taust1 exceeds the maximum fuel injection quantity τmax1, then not all of the necessary fuel injection quantity taust1 can be supplied to the normally activated cylinders. The fuel injection quantity will end up being insufficient by an amount corresponding to the difference between the necessary fuel injection quantity taust1 and the maximum fuel injection quantity τmax1, even if the injector 7 is driven to the fullest. This fuel injection quantity deficiency will result in the air-fuel ratio of the air-fuel mixture that flows into the cylinder from the intake port being lean, which may cause a misfire depending on the degree of leanness. Therefore, if the fuel that is able to be directly supplied to the normally activated cylinders is insufficient, it is necessary to supply fuel of an amount corresponding to the deficiency by a means other than a fuel injection by the corresponding injectors 7.

In this example embodiment, the delay activated cylinders are used as the means for supplying fuel of an amount corresponding to the deficiency to the normally activated cylinders. In this example embodiment, the arrangement of the normally activated cylinders and the delay activated cylinders is such that a delay activated cylinder is always arranged adjacent to a normally activated cylinder, as shown in FIG. 1. The #3 delay activated cylinder is adjacent to the #1 normally activated cylinder, the #5 delay activated cylinder is adjacent to the #7 normally activated cylinder, the #2 delay activated cylinder is adjacent to the #4 normally activated cylinder, and the #8 delay activated cylinder is adjacent to the #6 normally activated cylinder. Also, an intake valve stopping mechanism 8 is provided for each delay activated cylinder, as described above. The intake valve of each delay activated cylinder is kept closed by the intake valve stopping mechanism 8. Therefore, even if fuel is injected into the intake port of a delay activated cylinder, the injected fuel will not be drawn into the delay activated cylinder. Instead, some of the fuel injected into the intake port of the delay activated cylinder will adhere as it is to the intake port, and some of the fuel will vaporize and diffuse inside the intake manifold 5. This vaporized fuel that has diffused inside the intake manifold 5 is then drawn in, together with fresh air, to the adjacent normally activated cylinder. For example, fuel that has been injected into the intake port of the #3 delay activated cylinder is drawn mainly into the adjacent #1 normally activated cylinder via the intake manifold 5. That is, according to the structure shown in FIG. 1, by injecting fuel into the intake port of a delay activated cylinder, fuel is able to be indirectly supplied to a normally activated cylinder from the intake port of the delay activated cylinder via the intake manifold 5.

In this case, the ECU 10 executes steps S6, S8, and S10. In step S6, a fuel quantity taust2 that is to be injected into the intake port of a delay activated cylinder is calculated based on the difference between the necessary fuel injection quantity taust1 and the maximum fuel injection quantity τmax1, as is shown in the expression below.

$$taust2=\alpha\times(taust1-\tau max1)$$

In the expression above, the coefficient α is a correction coefficient that takes into account the amount of fuel that adheres to the intake port and the amount of adhered fuel that vaporizes. The value of this correction coefficient α is determined by the intake port temperature and the alcohol concentration of the fuel, just like the adhering percentage and the residual percentage described above. A map correlating the correction coefficient α with the intake port temperature and the alcohol concentration is stored in the ECU 10. The correction coefficient α corresponding to the intake port temperature and the alcohol concentration at startup is specified using this map, and the fuel quantity taust2 to be injected into the intake port of the delay activated cylinder is calculated according to the expression above using the specified correction coefficient α.

In step S8, a fuel injection is performed by the injector 7 for the normally activated cylinder for the injection time corresponding to the maximum fuel injection quantity τmax1. Then in step S10, a fuel injection is performed by the injector 7 for the delay activated cylinder for an injection time corresponding to the fuel injection quantity taust2 calculated in step S6. As a result, the fuel deficiency in the normally activated cylinder is compensated for by the fuel that circulates over from the intake port of the delay activated cylinder via the intake manifold 5, such that a lean misfire due to a fuel deficiency is inhibited in the normally activated cylinder.

In the next step, step S14, the ECU 10 determines whether the number of cycles that have passed after the engine 1 started has reached a reference number of cycles (such as five cycles) at which combustion in the delay activated cylinders may be initiated. This reference number of cycles may be set as appropriate as long as it is two or more cycles. The steps thereafter are skipped until the number of cycles that have passed reaches the reference number of cycles.

When the number of cycles that have passed has reached the reference number of cycles, the ECU 10 executes step S16. In step S16, the ECU 10 obtains information related to the alcohol concentration of the fuel. The alcohol concentration of the fuel that is used is able to be directly measured by providing an alcohol concentration sensor in the fuel tank or fuel line. Alternatively, the alcohol concentration can also be learned from a feedback correction amount of air-fuel ratio feedback control. However, in the former case in which the actual alcohol concentration is directly measured, the actual alcohol concentration of the current time is obtained, and in the latter case in which the alcohol concentration is learned, a learned value obtained by the last trip is obtained as a predicted alcohol concentration of the current time.

In the next step, step S18, the ECU 10 obtains a measured value of the intake pipe pressure. The intake pipe pressure is measured by an intake pipe pressure sensor provided in the intake pipe. The intake pipe pressure is a value that is equivalent to atmospheric pressure immediately after startup of the engine 1, i.e., at the time when the engine 1 is started. The intake pipe pressure becomes a negative pressure with the starting of the engine 1, and this negative pressure increases as the speed of the engine 1 increases.

In the next step, i.e., step S20, the ECU 10 calculates a necessary fuel injection quantity taust3 to initiate combustion in the delay activated cylinders. The necessary fuel injection quantity taust3 is the fuel injection quantity necessary to obtain a cylinder inflow fuel amount that is capable of realizing a target air-fuel ratio. The ECU 10 uses the alcohol concentration of the fuel obtained in step S16 and the intake pipe pressure obtained in step S18 as important information for calculating this necessary fuel injection quantity taust3. As the negative pressure in the intake pipe increases, more and more of the fuel adhered to the intake port vaporizes, so the fuel injection quantity necessary to obtain a desired cylinder inflow fuel amount decreases (i.e., less fuel needs to be injected to obtain a desired cylinder inflow fuel amount). On the other hand, as the alcohol concentration of the fuel increases, less and less of the fuel adhered to the intake port vaporizes, so the fuel injection quantity necessary to obtain the desired cylinder inflow fuel amount increases (i.e., more fuel needs to be injected to obtain the desired cylinder inflow fuel amount).

Also, the ECU 10 also uses the intake port temperature as supplementary information for calculating the necessary fuel injection quantity. The intake port temperature may be directly measured by a temperature sensor, or coolant temperature that can be measured by a coolant temperature sensor can be used as a substitute. When the intake port temperature is low, less of the fuel adhered to the intake port vaporizes, so the necessary fuel injection quantity for a delay activated cylinder is larger (i.e., more fuel must be injected into the intake port of a delay activated cylinder). Conversely, when the intake port temperature is high, more of the fuel adhered to the intake port vaporizes, so the necessary fuel injection quantity of the delay activated cylinder is smaller (i.e., less fuel must be injected into the intake port of the delay activated cylinder).

Figure 3:
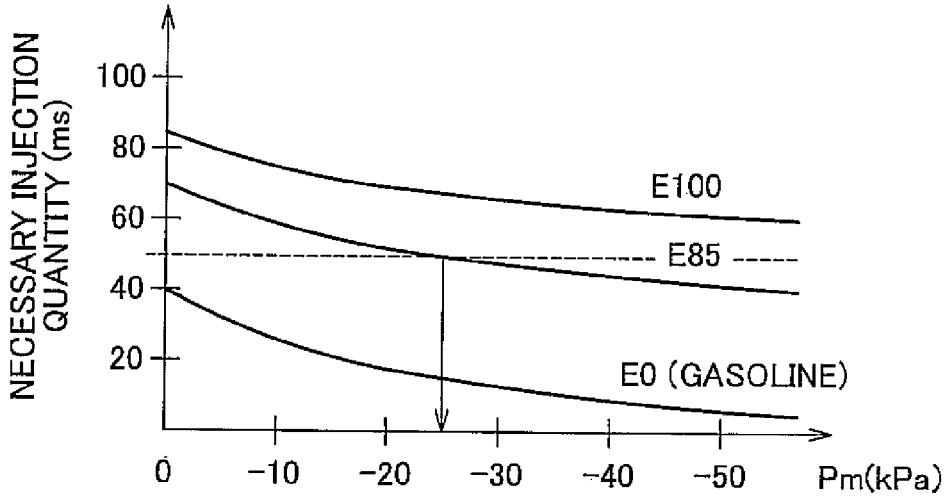
FIG. 3 is an image of a map for determining a required fuel injection quantity when initiating combustion in the delay activated cylinders based on an intake pipe pressure and alcohol concentration used with startup control according to the example embodiment of the invention.
Figure 4:
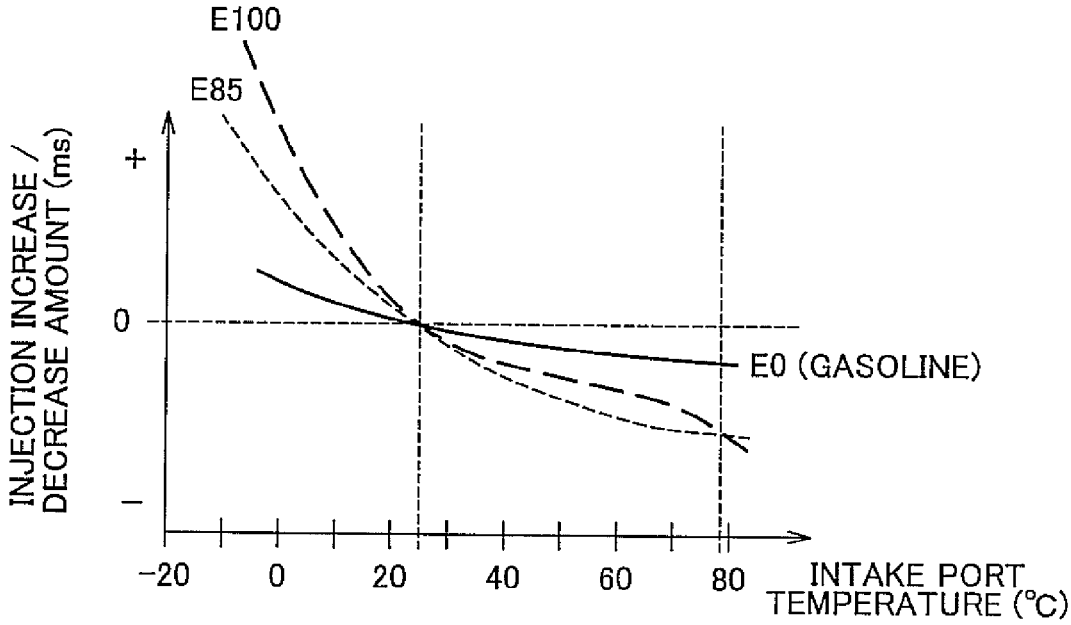
FIG. 4 is an image of a map for determining an injection increase/decrease amount when initiating combustion in the delay activated cylinders based on an intake pipe pressure and alcohol concentration used with startup control according to the example embodiment of the invention.

Two kinds of maps for determining the necessary fuel injection quantity of a delay activated cylinder are stored in the ECU 10. One is a map that correlates a base amount of the necessary fuel injection quantity with the intake pipe pressure and the alcohol concentration of the fuel. FIG. 3 is an image of this map. The other is a map that correlates an injection increase/decrease amount of the necessary fuel injection quantity with the intake port temperature and the alcohol concentration of the fuel. FIG. 4 is an image of this map. The curves that show the relationship between the intake pipe pressure Pm and the necessary fuel injection quantity in FIG. 3, and the curves that show the relationship between the intake port temperature and the injection increase/decrease amount of the necessary fuel injection quantity in FIG. 4, are depicted when fuel with an alcohol concentration of 100% (i.e., E100) is used, when fuel with an alcohol concentration of 85% (i.e., E85) is used, and when fuel with an alcohol concentration of 0% (i.e., E0) is used, respectively. In FIGS. 3 and 4, only these three alcohol concentrations are shown, but in an actual map, the alcohol concentrations are subdivided much more finely. The ECU 10 calculates the base amount of the necessary fuel injection quantity corresponding to the amount of negative pressure in the intake pipe and the alcohol concentration using the map shown in FIG. 3. The ECU 10 also calculates the injection increase/decrease amount of the necessary fuel injection quantity corresponding to the intake port temperature and the alcohol concentration using the map shown in FIG. 4. Then the ECU 10 calculates a quantity of fuel in which the injection increase/decrease amount has been added to the base amount, as the necessary fuel injection quantity taust3 of the delay activated cylinders.

In the next step, step S22, the ECU 10 determines whether fuel has been injected into the intake port of a delay activated cylinder. A fuel injection into the intake port of a delay activated cylinder in this case refers to the fuel injection executed in step S10, i.e., a fuel injection to compensate for a fuel deficiency in a normally activated cylinder. If a fuel injection is performed in step S10, there should be some residual fuel adhered to the intake port of the delay activated cylinder. The necessary fuel injection quantity taust3 anticipates the amount of fuel injected from the injector 7 that will adhere to the intake port, so if there is residual fuel in the intake port, the necessary fuel injection quantity taust3 can be that much less.

Therefore, the ECU 10 executes step S24 only when there has been a fuel injection into the intake port of a delay activated cylinder. In step S24, the amount of residual fuel in the intake port of the delay activated cylinder is calculated based on the total amount of fuel injected into the delay activated cylinder in order to compensate for the fuel deficiency in the normally activated cylinder, and the percentage of fuel flowing out of the intake pipe of the delay activated cylinder into the intake pipe of the normally activated cylinder (i.e., the outflow rate). The outflow rate is determined by the intake port temperature, the alcohol concentration of the fuel, and the amount of negative pressure generated in the intake pipe. A map that correlates the outflow rate of the fuel with the intake port temperature, the alcohol concentration, and the intake pipe pressure is stored in the ECU 10. The outflow rate of the fuel is specified using this map, and the amount of residual fuel (i.e., the residual fuel amount) in the intake port is calculated using this outflow rate. The ECU 10 corrects, i.e., reduces, the necessary fuel injection quantity taust3 according to this calculated residual fuel amount.

In the next step, step S26, the ECU 10 determines whether the necessary fuel injection quantity taust3 is greater than a maximum fuel injection quantity $\tau max2$ that is determined by the injection performance of the injector 7. The maximum fuel injection quantity during an intake-asynchronous injection is determined by the period from the time the intake valve closes until the time the intake valve opens. Therefore, this maximum fuel injection quantity $\tau max2$ that is used in step S26 is not necessarily the same as the maximum fuel injection quantity $\tau max1$ that is used in step S4. However, it is possible to use the same value.

If the necessary fuel injection quantity taust3 is greater than the maximum fuel injection quantity $\tau max2$, then not all of the necessary fuel injection quantity taust3 can be supplied to the delay activated cylinder. The fuel injection quantity will end up being insufficient by an amount corresponding to the difference between the necessary fuel injection quantity taust3 and the maximum fuel injection quantity $\tau max2$, even if the injector 7 is driven to the fullest. This fuel injection quantity deficiency will result in the air-fuel ratio of the air-fuel mixture that flows into the cylinder from the intake port being lean, which may cause a misfire depending on the degree of leanness. In this case, the ECU 10 executes step S28 and keeps the delay activated cylinder on standby without initiating combustion in it. If the delay activated cylinder is kept on standby without combustion being initiated in it, the negative pressure in the intake pipe will increase as the engine speed increases during that time. Also, more and more of the fuel adhered to the intake port vaporizes due to this increase in negative pressure, so the fuel injection quantity taust3 necessary to initiate combustion in the delay activated cylinder gradually decreases. That is, if the delay activated cylinder is kept on standby without combustion being initiated in it, the necessary fuel injection quantity taust3 will soon enter a range of quantities that are able to be injected by the injector 7.

If the necessary fuel injection quantity taust3 is equal to or less than the maximum fuel injection quantity τmax2, then all of the necessary fuel injection quantity taust3 can be supplied into the delay activated cylinder. In this case, the ECU 10 executes step S30. In step S30, combustion in the delay activated cylinder is initiated momentarily and a fuel injection by the injector 7 is performed for the delay activated cylinder for an injection time that corresponds to the necessary fuel injection quantity taust2.

According to the delayed activation control of this example embodiment described above, it is possible to obtain a sufficient unburned HC discharge suppression effect that is obtained by starting the internal combustion engine by initiating combustion in only some (i.e., the normally activated cylinders) of the plurality of cylinders, and then initiating combustion in the remaining cylinders (i.e., the delay activated cylinders) after the engine 1 has started, even when fuel containing alcohol is used.

According to steps S2 to S12 in particular, even if the fuel that is able to be directly injected into the intake port of a normally activated cylinder is insufficient, fuel is able to be indirectly supplied to the normally activated cylinder from the intake port of a delay activated cylinder via the intake manifold 5. Furthermore, a delay activated cylinder is always adjacent to a normally activated cylinder and the number of adjacent delay activated cylinders is the same for each of the normally activated cylinders, which makes it possible to suppress the fuel that circulates over to a normally activated cylinder from a delay activated cylinder via the intake manifold 5 from becoming uneven. As a result, a lean misfire due to a fuel deficiency is inhibited when starting the engine 1 by initiating combustion in the normally activated cylinders.

Also, according to steps S16 to S30 in particular, when initiating combustion in a delay activated cylinder, a predetermined amount of fuel can be supplied into the cylinder irrespective of the alcohol concentration of the fuel, so the generation of unburned HC due to a lean misfire can be suppressed. Also, the generation of unburned HC due to the air-fuel ratio being overly rich can be suppressed by injecting an appropriate amount of fuel.

While various example embodiments of the invention have been described, it is to be understood that the invention is not limited to the described embodiments, but may be embodied with various modifications without departing from the scope of the invention.

Figures 5A, 5B, 5C, 5D, 5E:
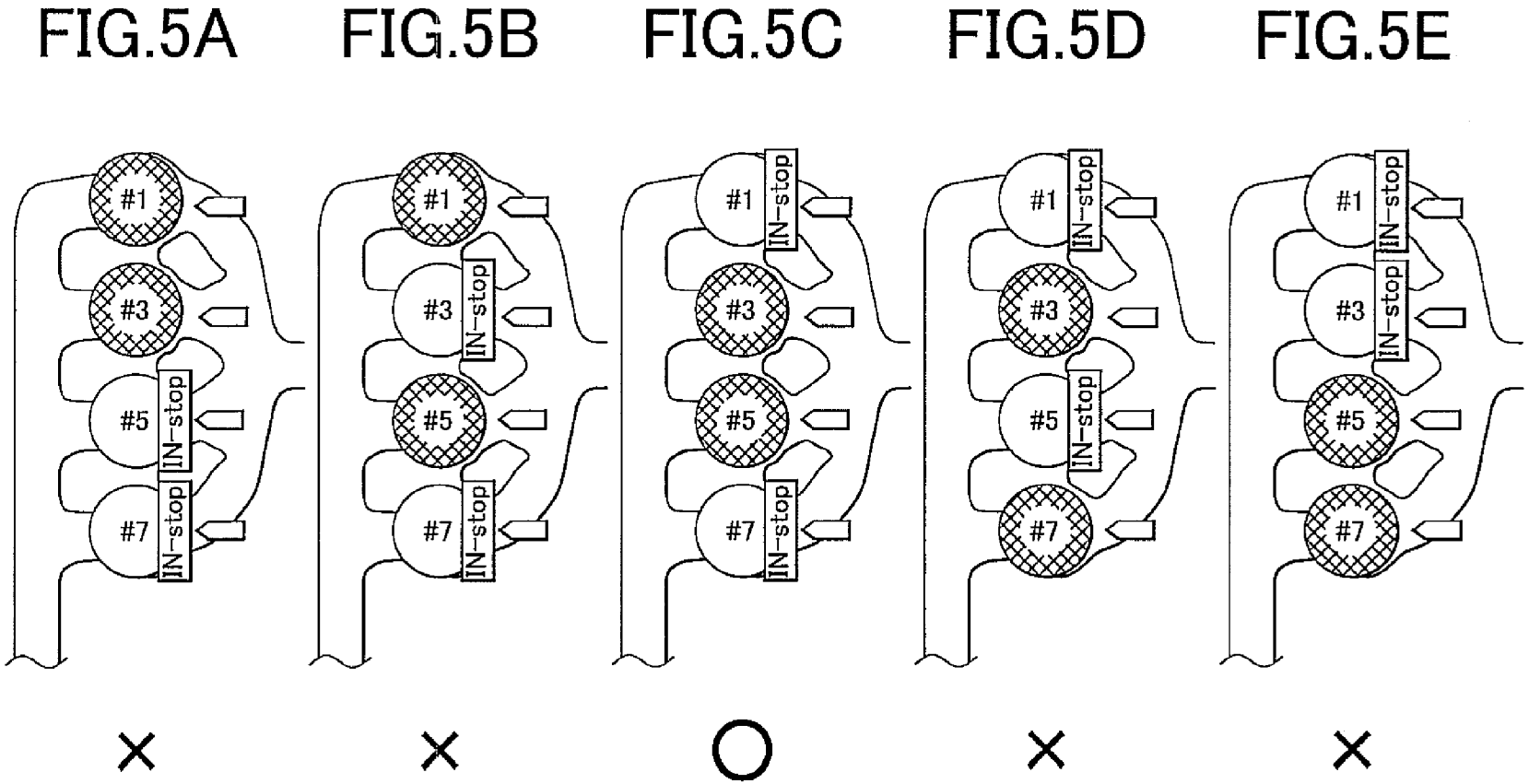
FIG. 5 is a view of example arrangements of normally activated cylinders and delay activated cylinders.

For example, FIG. 5 is a view of other examples of arrangements of normally activated cylinders and delay activated cylinders in the left bank of the engine 1 shown in FIG. 1. An example of a preferable arrangement is marked by an "O" and examples that are not preferable are marked with an "X". The only preferable example in A to E is example C. With the arrangements in examples A and E, there is a normally activated cylinder (i.e., the #1 cylinder in example A and the #7 cylinder in example E) that does not have an adjacent delay activated cylinder. With these arrangements, it is unlikely that the fuel will cross over from the delay activated cylinders to these normally activated cylinders, so the fuel may become uneven among the normally activated cylinders. With the arrangements in examples B and D, on the other hand, each normally activated cylinder does have an adjacent delay activated cylinder, but one normally activated cylinder (i.e., the #1 cylinder in example B and the #7 cylinder in example D) has only one adjacent delay activated cylinder while the other normally activated cylinder (i.e., the #5 cylinder in example B and the #3 cylinder in example D) has two adjacent delay activated cylinders. A normally activated cylinder having a larger number of adjacent delay activated cylinders will receive more cross-over fuel, so in this case as well, the fuel may become uneven among the normally activated cylinders. In contrast, with the arrangement in example C, there is always a delay activated cylinder adjacent to each normally activated cylinder, and the number of adjacent delay activated cylinders is the same for each of the normally activated cylinders, just as in the example embodiment described above. Therefore, according to the arrangement in example C, the amount of fuel that crosses over from the delay activated cylinder to the normally activated cylinder via the intake manifold is inhibited from becoming uneven among the normally activated cylinders.

Also, in the engine 1 in FIG. 1, a heat source (such as a PTC heater) may be arranged in the intake port of each delay activated cylinder and the intake port may be heated by the heat source if the determination in step S4 is yes. This promotes the vaporization of the fuel that has been injected into the intake port of each delay activated cylinder, so the amount of fuel that crosses over from a delay activated cylinder to a normally activated cylinder via the intake manifold can be increased. Incidentally, the heat source for the intake port is preferably positioned at or near a portion where fuel that is injected from the injector 7 adheres.

Alternatively, an exhaust valve stopping mechanism that stops an exhaust valve in the closed position may be provided instead of the intake valve stopping mechanism provided in each delay activated cylinder in the example embodiment described above. If the exhaust valve is stopped until combustion in a delay activated cylinder is initiated, fuel injected into the intake port of the cylinder will not be discharged to the exhaust pipe during that time. As a result, it is also possible to indirectly supply fuel from the intake port of a delay activated cylinder to a normally activated cylinder via the intake manifold when stopping the exhaust valve instead of the intake valve.

Also, in the example embodiments described above, the engine is described as being a V-type 8-cylinder engine, but the invention may of course also be applied to any engine as long as it is a multiple cylinder engine in which combustion is able to be initiated in only some of a plurality of cylinders.

What is claimed is:

1. A control apparatus for an internal combustion engine that injects fuel that includes alcohol into an intake port of each cylinder from an injector provided for each cylinder, comprising:

an engine starting portion that starts the internal combustion engine by initiating combustion in cylinders belonging to a first cylinder group;

an intake pipe pressure monitoring portion that monitors a change in an amount of negative pressure generated in an intake pipe with the starting of the internal combustion engine;

an alcohol concentration information obtaining portion that obtains information related to an alcohol concentration of the fuel being used in the internal combustion engine;

a necessary fuel injection quantity calculating portion that calculates a fuel injection quantity necessary to initiate combustion in cylinders belonging to a second cylinder group that are different from the cylinders that make up the first cylinder group, based on the amount of negative pressure generated in the intake pipe and the alcohol concentration of the fuel; and a second cylinder group combustion initiating portion that initiates combustion in each of the cylinders belonging to the second cylinder group after the fuel injection quantity necessary to initiate combustion enters a range of quantities that are able to be injected by the corresponding injectors;

wherein when the fuel injection quantity necessary to initiate combustion in one or more of the cylinders belonging to the first cylinder group exceeds the range of quantities that are able to be injected by the corresponding one or more injectors, the engine starting portion injects fuel of a quantity corresponding to the excess from one or more of the injectors belonging to the second cylinder group.

2. The control apparatus according to claim 1, wherein the engine starting portion closes an intake valve or an exhaust valve of each of the cylinders belonging to the second cylinder group until combustion is initiated in each of the cylinders belonging to the second cylinder group.

3. The control apparatus according to claim 2, wherein the cylinders belonging to the second cylinder group are adjacent to the cylinders belonging to the first cylinder group, and the number of cylinders belonging to the second cylinder group that are adjacent to each cylinder belonging to the first cylinder group is the same for all of the cylinders belonging to the first cylinder group.

4. A control method for an internal combustion engine that injects fuel that includes alcohol into an intake port of each cylinder from an injector provided for each cylinder, comprising:

starting the internal combustion engine by initiating combustion in cylinders belonging to a first cylinder group;

monitoring a change in an amount of negative pressure generated in an intake pipe with the starting of the internal combustion engine;

obtaining information related to an alcohol concentration of the fuel being used in the internal combustion engine;

calculating a fuel injection quantity necessary to initiate combustion in cylinders belonging to a second cylinder group that are different from the cylinders that make up the first cylinder group, based on the amount of negative pressure generated in the intake pipe and the alcohol concentration of the fuel; and initiating combustion in each of the cylinders belonging to the second cylinder group after the fuel injection quantity necessary to initiate combustion enters a range of quantities that are able to be injected by the corresponding injectors;

wherein when the fuel injection quantity necessary to initiate combustion in one or more of the cylinders belonging to the first cylinder group exceeds the range of quantities that are able to be injected by the corresponding one or more injectors, a quantity of fuel corresponding to the excess is injected from one or more of the injectors belonging to the second cylinder group.

5. The control method according to claim 4, further comprising:

closing an intake valve or an exhaust valve of each of the cylinders belonging to the second cylinder group until combustion is initiated in each of the cylinders belonging to the second cylinder group;

wherein the cylinders belonging to the second cylinder group are adjacent to the cylinders belonging to the first cylinder group, and the number of cylinders belonging to the second cylinder group that are adjacent to each cylinder belonging to the first cylinder group is the same for all of the cylinders belonging to the first cylinder group;

wherein the internal combustion engine includes a first cylinder bank and a second cylinder bank, each of said first cylinder bank and said second cylinder bank having a pair of outer cylinders and a pair of inner cylinders, and wherein said pair of outer cylinders of said first cylinder bank and said pair of inner cylinders of said second cylinder bank are one of said first cylinder group or said second cylinder group and said pair of inner cylinders of said first cylinder bank and said pair of outer cylinders of said second cylinder bank are the other of said first cylinder group or said second cylinder group.

6. The control apparatus according to claim 3, wherein the internal combustion engine includes a first cylinder bank and a second cylinder bank, each of said first cylinder bank and said second cylinder bank having a pair of outer cylinders and a pair of inner cylinders, and wherein said pair of outer cylinders of said first cylinder bank and said pair of inner cylinders of said second cylinder bank are one of said first cylinder group or said second cylinder group and said pair of inner cylinders of said first cylinder bank and said pair of outer cylinders of said second cylinder bank are the other of said first cylinder group or said second cylinder group.

7. The control apparatus according to claim 2, further comprising:

a residual fuel amount calculating portion that calculates an amount of residual fuel in the intake port of each of the cylinders belonging to the second cylinder group, based on the quantity of fuel injected into the intake port of each of the cylinders belonging to the second cylinder group before combustion is initiated in each of the cylinders belonging to the second cylinder group; and a necessary fuel injection quantity correcting portion that corrects the fuel injection quantity necessary to initiate combustion in each of the cylinders belonging to the second cylinder group according to the amount of residual fuel in the intake port.

* * * * *